US005273061A

United States Patent [19]

Milocco

[11] Patent Number: 5,273,061

[45] Date of Patent: Dec. 28, 1993

[54] DISHWASHER WITH DRYING BY CONDENSATION

[75] Inventor: Claudio Milocco, Pordenone, Italy

[73] Assignee: Zanussi Elettrodomestici S.p.A., Italy

[21] Appl. No.: 981,068

[22] Filed: Nov. 24, 1992

[30] Foreign Application Priority Data

Nov. 26, 1991 [IT] Italy ..... PN91 A 00039

[51] Int. Cl.[5] ..... B08B 3/10

[52] U.S. Cl. ..... 134/105; 134/102.3; 134/186; 134/155; 134/56 D

[58] Field of Search ..... 134/56 D, 57 D, 58 D, 134/105, 102.3, 155, 186, 200; 34/73, 75

[56] References Cited

U.S. PATENT DOCUMENTS 3,103,227 9/1963 Long ..... 134/105 X
3,241,563 3/1966 Braden ..... 134/102.3 X
3,739,145 6/1973 Woehler ..... 134/102.3 X
3,807,420 4/1974 Donselman ..... 134/102.3 X
4,195,419 4/1980 Quayle ..... 134/102.3
5,056,543 10/1991 Dygve ..... 34/73 X
5,165,431 11/1992 Tromblee et al. ..... 134/56 D
5,187,954 2/1993 Kim et al. ..... 69/23.7

*Primary Examiner*—Frankie L. Stinson
*Attorney, Agent, or Firm*—Pearne, Gordon, McCoy & Granger

[57] ABSTRACT

A dishwasher whose drying system works by condensation, having a washtub (3) in heat-exchange contact with a duct (8) that may be closed by a non-return valve and having a fan (14) suitable for causing a flow of cooling air to circulate. The dishwasher also includes a circulation pump (4) and a discharge pump (5), whose rotors are connected to the driveshaft (6) of a reversible motor (7), to pump water to their corresponding force ducts when the shaft is rotating in one direction or the other, respectively. The valve plug (15) is pneumatically switchable by the fan (14) between a closed position and an open position of the duct (8) when the shaft (6) rotates in one direction or the other, so that the flow of air circulates only when the discharge pump (5) is operating.

2 Claims, 1 Drawing Sheet

DISHWASHER WITH DRYING BY CONDENSATION

BACKGROUND OF THE INVENTION

1. Field of the Invention

This invention relates to a dishwasher machine provided with a dishwasher system of a type utilizing an air/air heat exchanger for the condensation of the water vapor.

2. Description of Related Art

A dishwasher is described, for example, in DE-C2-3 515 592 which comprises a duct in which relatively cool air drawn from a room is caused to circulate in heat exchange with the machine's washtub and is again discharged into the room. Thus, a portion of the washtub wall is a heat exchanger which, at the end of the hot water dish-rinsing cycle, promotes condensation of the water vapor inside the tub, and hence the drying of the dishes. The cooling air of the heat exchanger is made to circulate in this duct by means of a fan mounted on the shaft of a motor that drives a pump. Inasmuch as such cooling airflow must take place only during the drying phase, the dishwasher is equipped with an electromechanically controlled valve, which may diminish the machine's reliability. Wiring for the valve is relatively complex and expensive, and, in addition, it is obviously necessary to provide such a dishwasher with a special fan to produce the air flow in the cooling duct.

SUMMARY OF THE INVENTION

The purpose of this invention is to provide a dishwasher with an effective air-drying system requiring a minimum number of simple and reliable components. According to the invention, this purpose is served in a dishwasher with a system of drying by condensation that incorporates the characteristics of the attached claims.

BRIEF DESCRIPTION OF THE DRAWING

The characteristics and advantages of the invention will be clarified by the following description, serving only as an example without being limiting, with references to the attached drawing, in which the single FIGURE schematically shows an elevational side view in cross-section of the dishwasher's main components in the preferred construction configuration.

DETAILED DESCRIPTION OF THE PREFERRED EMBODIMENT

Figure 1:
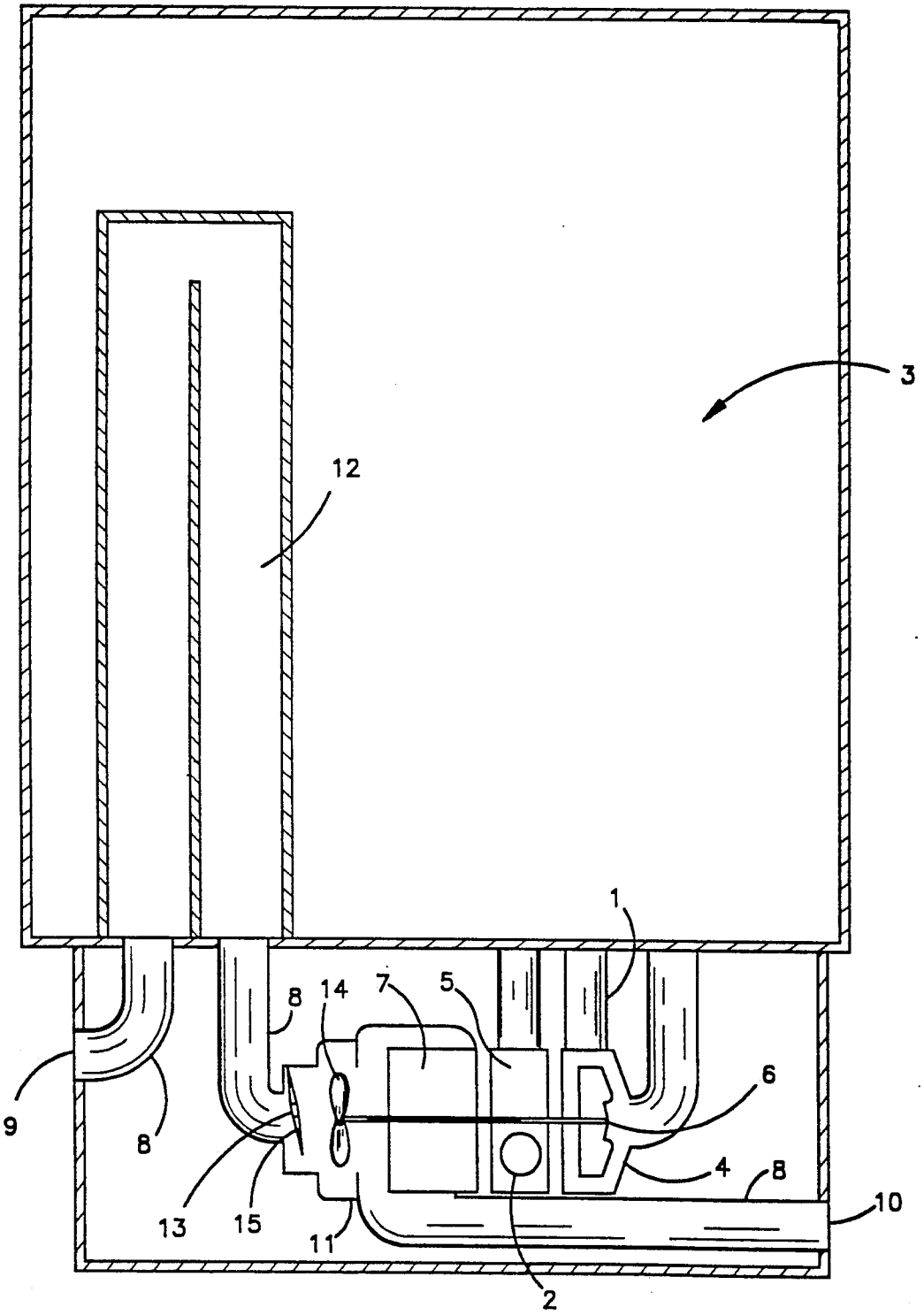

Referring to the FIGURE, in which, for the sake of descriptive simplicity, only the components necessary for an understanding of this invention are shown, the dishwasher consists mainly of a washtub (3) and a single-motor pumping assembly of the type described in U.S. Pat. No. 4,799,855. In particular, the pumping assembly includes a circulation pump (4), suitable to feed the dishwasher's revolving spray nozzles (not shown), and a discharge pump (5). Rotors of the two pumps are connected to the driveshaft (6) of a reversible motor (7) governed by a controller. The circulation pump (4) pumps water through a force duct (1) when the driveshaft is rotating in one direction during washing. The discharge pump (5) pumps water through another force duct (2) when the driveshaft is rotating in the opposite direction during drying.

In a known manner, the dishwasher also includes a passage for air flow that extends from an intake (9) to an outlet (10) venting to a room outside the machine and preferably placed at the base of the machine. The air passage is substantially confined to a duct (8), a portion of which acts as a heat-exchanger with a portion of a wall of the washtub (3), which is preferably box-shaped, to constitute a condensation device (12). Preferably, the duct (8) also includes a portion of greater cross-section that houses at least the motor (7) of the pumping assembly (4,5,6 and 7). The pumping assembly also has a fan (14), which is shrink-fitted to the driveshaft (6) and housed in a portion of the duct (8) upstream from the motor (7).

The duct (8) is provided with a non-return valve (15) placed upstream from the fan (14), which has a flexible-membrane or similar plug. The plug (15) is such that it can be pneumatically switched by the fan (14) between closed and open positions of the duct (8) when the driveshaft (6) is turning.

In particular, when the driveshaft turns in the direction necessary to carry out the washing phase, the circulation pump (4) is driven and the fan (14) pushes air toward the valve (15), which tends to keep the duct closed. Thus, during the washing phase no substantial heat exchange takes place between the washtub (3) and the room outside the tub. In a know manner, during the washing phase, the discharge pump (5) is stopped so that it represents a negligible load to the driver motor. The fan (14) (preferably of the radial-blade type) keeps the duct (8) closed. When, at the end of a washing phase, the shaft (6) turns in the opposite direction in the discharge phase, the discharge pump (5) is activated and the fan (14) produces a flow of room air, which switches the valve (15) to an open position, as shown in the FIGURE. In particular, such airflow (relatively cool) penetrates the intake opening (9), passes through the duct (8) with the heat-exchanger (12) and through the outlet (10) after having passed the motor (7). During the discharge phase, in which the circulation pump (4) is inactive, substantial cooling of the heat-exchanger (12) is achieved that makes condensation of the vapor inside the washtub (3) possible, and therefore produces efficient drying of the dishes. In a known manner, the condensate is collected on the bottom of the tub (3), to be evacuated by the discharge pump (5).

The simplicity of construction and operational reliability of dishwashers built in accordance with the invention, and which require no additional components, are self-evident.

To further simplify the machine, the non-return valve (15) may be made with a calibrated opening (13) which, during the washing phase, allows the fan (14) to produce an airflow in the duct (8) from the outlet opening (10) toward the intake opening. (9), thus advantageously cooling the motor (7). Therefore, the fan (14) has the double function of causing cooling air to circulate through the heat-exchanger (12) and of cooling the driving motor (7), which thus does not require its own cooling fan.

Obviously the dishwasher described can undergo numerous modifications while still remaining within the scope of the invention.

What I claim is:

1. A dishwasher using a system of drying by condensation, including a washtub; at least one separate duct isolated from the interior of the washtub, said duct being in heat-exchange relationship with the washtub, and in communication with the exterior environment of the washtub, which duct may be closed by means of a valve; a means of ventilation suitable to cause circulation of a substantial flow of relatively cool air through said duct; a circulation pump whose rotor is connected to a driveshaft of a reversible motor, to pump water to a corresponding first force duct when the driveshaft is turning in one direction; and a discharge pump, whose rotor is connected to the driveshaft to pump water to a corresponding second force duct when the driveshaft is turning in the other direction, characterized in that the valve comprises a non-return valve having a plug (15) that is pneumatically switchable by means of the ventilation means (14) between the closed and open positions of the duct (8) as the driveshaft (6) reverses its turning direction, thereby causing air circulation only when the discharge pump (5) is in operation.

2. A dishwasher according to claim 1, wherein the means of ventilation comprises a fan (14) shrink-fitted to the driveshaft (6) and suitable to produce air circulation, thereby cooling the motor (7), through a calibrated opening (13) in the plug (15) when the driveshaft turns in the one direction.

* * * * *